US009080347B2

(12) United States Patent
Le

(10) Patent No.: US 9,080,347 B2
(45) Date of Patent: Jul. 14, 2015

(54) DEFEATER LATCH HANDLE

(71) Applicant: Tam Le, Santa Ana, CA (US)

(72) Inventor: Tam Le, Santa Ana, CA (US)

(73) Assignee: S.P.E.P. ACQUISITION CORP., Long Beach, CA (US)

( * ) Notice: Subject to any disclaimer, the term of this patent is extended or adjusted under 35 U.S.C. 154(b) by 40 days.

(21) Appl. No.: 14/059,295

(22) Filed: Oct. 21, 2013

(65) Prior Publication Data

US 2015/0107314 A1 Apr. 23, 2015

(51) Int. Cl.
*E05B 1/00* (2006.01)
*E05B 13/10* (2006.01)
*E05B 13/00* (2006.01)

(52) U.S. Cl.
CPC ..... *E05B 1/003* (2013.01); *E05B 13/108* (2013.01); *E05B 13/002* (2013.01)

(58) Field of Classification Search
CPC ..... E05B 13/002; E05B 1/00; E05B 13/108; E05B 1/003
USPC ..... 70/215, 207, 209, 210, 211, 212, 216, 70/221, 224, 447, 452; 292/200, 202, 205, 292/207, 210, 226, 336.3, 347, 356, 359, 292/DIG. 30
See application file for complete search history.

(56) References Cited

U.S. PATENT DOCUMENTS 2,949,328 A * 8/1960 Kaiser ..... 292/207
3,508,423 A * 4/1970 Harrell et al. ..... 70/78
4,565,080 A * 1/1986 Kincaid et al. ..... 70/215
5,469,725 A * 11/1995 Yamada ..... 70/208
5,634,357 A * 6/1997 Nutter et al. ..... 70/210
5,664,448 A * 9/1997 Swan et al. ..... 70/224
D385,768 S 11/1997 Nutter
6,068,308 A * 5/2000 Molzer ..... 292/336.3
6,264,255 B1 * 7/2001 Fortune ..... 292/336.3
6,318,770 B1 11/2001 Molzer
6,494,509 B2 12/2002 Molzer
6,502,872 B1 * 1/2003 Molzer ..... 292/336.3
6,546,765 B1 * 4/2003 Linares ..... 70/210
6,702,342 B2 3/2004 Molzer
6,715,807 B2 4/2004 Molzer
D521,846 S 5/2006 Toikka et al.
7,819,443 B2 * 10/2010 Ryan ..... 292/336.3
D709,351 S * 7/2014 Le ..... D8/331
2002/0148259 A1 * 10/2002 Finkelstein et al. ..... 70/92
2004/0237605 A1 * 12/2004 Lin et al. ..... 70/68

* cited by examiner

*Primary Examiner* — Peter M Cuomo
*Assistant Examiner* — Amanda L Miller
(74) *Attorney, Agent, or Firm* — Karish & Bjorgum, PC

(57) ABSTRACT

A defeater latch handle with a handle, a lock, and escutcheon. The handle has a through hole and a recess. The recess has a generally semi-circular ring portion and a recess notch portion that communicates with and extends out of the semi-circular ring portion. The lock is accessible through the cylinder hole. Opening the lock moves a movable blocking device to an unlocked state. The escutcheon has a bore formed therein. The bore has a notch formed therein that receives the blocking device when in its locked state. A trigger slot formed in the escutcheon receives a slidable trigger with an extension catch. In a locked state, the extension catch is in the recess notch. In an unlocked state, the extension catch moves out of the recess notch and into the semi-circular ring portion. The handle can only be turned when both the lock and the slidable trigger are unlocked.

20 Claims, 16 Drawing Sheets

DEFEATER LATCH HANDLE

FIELD OF THE INVENTION

The invention relates to the field of locking latches, and more particularly relates to latching handles that include two separate locking features for use with cabinets, doors, and the like.

BACKGROUND OF THE INVENTION

Latching mechanisms with handles that require two hands to operate are sometimes referred to in the field of latches as "defeater handles", or latches with a "defeater" feature. In defeater handles, the handle is rotatably connected to an escutcheon mounted on a door. Turning the handle moves a cam to lock or unlock the door. Many prior defeater latches utilize two separate locking features. One locking feature is a release mechanism having a trigger on the handle. The trigger is biased to a locked position when not being activated by a user. In the locked position, the trigger engages with the escutcheon and prevents the handle from being turned, and thus provides a first feature to prevent a door from being opened. The second locking feature is a release mechanism that includes a lock cylinder or a turnable cylinder situated in a head portion of the handle. The internal lock cylinder or turnable cylinder is biased to a locked position where the handle cannot be turned relative to the escutcheon. Only when the user manually turns and holds the lock cylinder or turnable cylinder in the unlocked position will the user be able to turn the handle to open the door. Thus, in defeater handles with two locking features, two hands are needed to operate the handle. Finally, some currently available defeater latches include a padlock clasp feature which is used to padlock the handle to the escutcheon to further prevent operation of the latch.

Unfortunately, prior art defeater handles are unnecessarily complex in design and overly cumbersome to operate. There accordingly remains a need for new designs of defeater handles that offer an enhanced level of security while being easier to operate, more robust and simple in design to lower manufacturing costs, and less prone to malfunction or failure through years of use and weathering.

SUMMARY OF THE INVENTION

In one embodiment the invention is a defeater latch handle, comprising; a handle with a base portion with a top and a bottom, a recess formed in a bottom of the base portion, the recess including recess notch portion, and a cylinder hole formed through the base portion; a lock that is received in and accessible through the top of base portion through the cylinder hole, the lock being rotatable relative to the base portion between a locked state and an unlocked state, the lock having an engagement; a handle insert with a movable blocking device, the movable blocking device being engaged with the engagement of the lock to move the movable blocking device between a lock state and an unlocked state, the handle insert being attached to the base portion; a shaft extending from the handle insert; an escutcheon having a bore formed therein to rotatably receive the shaft, the bore having a bore notch formed therein which bore notch is adapted to receive the blocking device when the blocking device is in its locked stated, the escutcheon have a trigger slot formed therein; and a slidable trigger with an extension catch, the slidable trigger being is adapted to slide in the trigger slot between a locked state, wherein the extension catch is positioned in the recess notch, and an unlocked state, wherein the extension catch is moved out of the recess notch; wherein the handle can only be rotated relative to the escutcheon when both the lock and the slidable trigger are in their unlocked states.

In another embodiment, the invention is a defeater latch handle, comprising: a handle with a base portion with a top and a bottom, a recess formed in a bottom of the base portion, the recess including a generally semi-circular ring portion and a recess notch portion that communicates with and extends out of the semi-circular ring portion, and a cylinder hole formed through the base portion; a lock that is received in and accessible through the top of base portion through the cylinder hole, the lock being rotatable relative to the base portion between a locked state and an unlocked state, the lock having an engagement; a biasing device to rotate the lock to its locked state; a handle insert with a movable blocking device, the movable blocking device being engaged with the engagement on the lower end of the lock to move the movable blocking device between a lock state and an unlocked state, the handle insert being attached to the base portion; a shaft extending from the handle insert; an escutcheon having a bore formed therein to rotatably receive the shaft, the bore having a bore notch formed therein which notch is adapted to receive the blocking device when the blocking device is in its locked stated, the escutcheon have a trigger slot formed therein; a slidable trigger with an extension catch, the slidable trigger being is adapted to slide in the trigger slot between a locked state, wherein the extension catch is positioned in the recess notch, and an unlocked state, wherein the extension catch is moved out of the recess notch and into the semi-circular ring portion; a biasing device to bias the trigger latch to is locked state; and a lock cam that is attached to the shaft; wherein the handle can only be rotated relative to the escutcheon when both the lock and the slidable trigger are in their unlocked states.

In yet another embodiment the invention provides a defeater latch handle, comprising: a handle with a base portion with a top and a bottom, a recess formed in a bottom of the base portion, the recess including recess notch portion, and a cylinder hole formed through the base portion; a lock that is received in and accessible through the top of base portion through the cylinder hole, the lock being rotatable relative to the base portion between a locked state and an unlocked state, the lock having an engagement; a movable blocking device, the movable blocking device being engaged with the engagement of the lock to move the movable blocking device between a lock state and an unlocked state; a shaft extending below the bottom of base portion of the handle; an escutcheon having a bore formed therein through which rotatably passes the shaft, the bore having a bore notch formed therein which bore notch is adapted to receive the blocking device when the blocking device is in its locked stated, the escutcheon have a trigger slot formed therein; and a slidable trigger with an extension catch, the slidable trigger being is adapted to slide in the trigger slot between a locked state, wherein the extension catch is positioned in the recess notch, and an unlocked state, wherein the extension catch is moved out of the recess notch; wherein the handle can only be rotated relative to the escutcheon when both the lock and the slidable trigger are in their unlocked states.

DETAILED DESCRIPTION

Figure 1A:
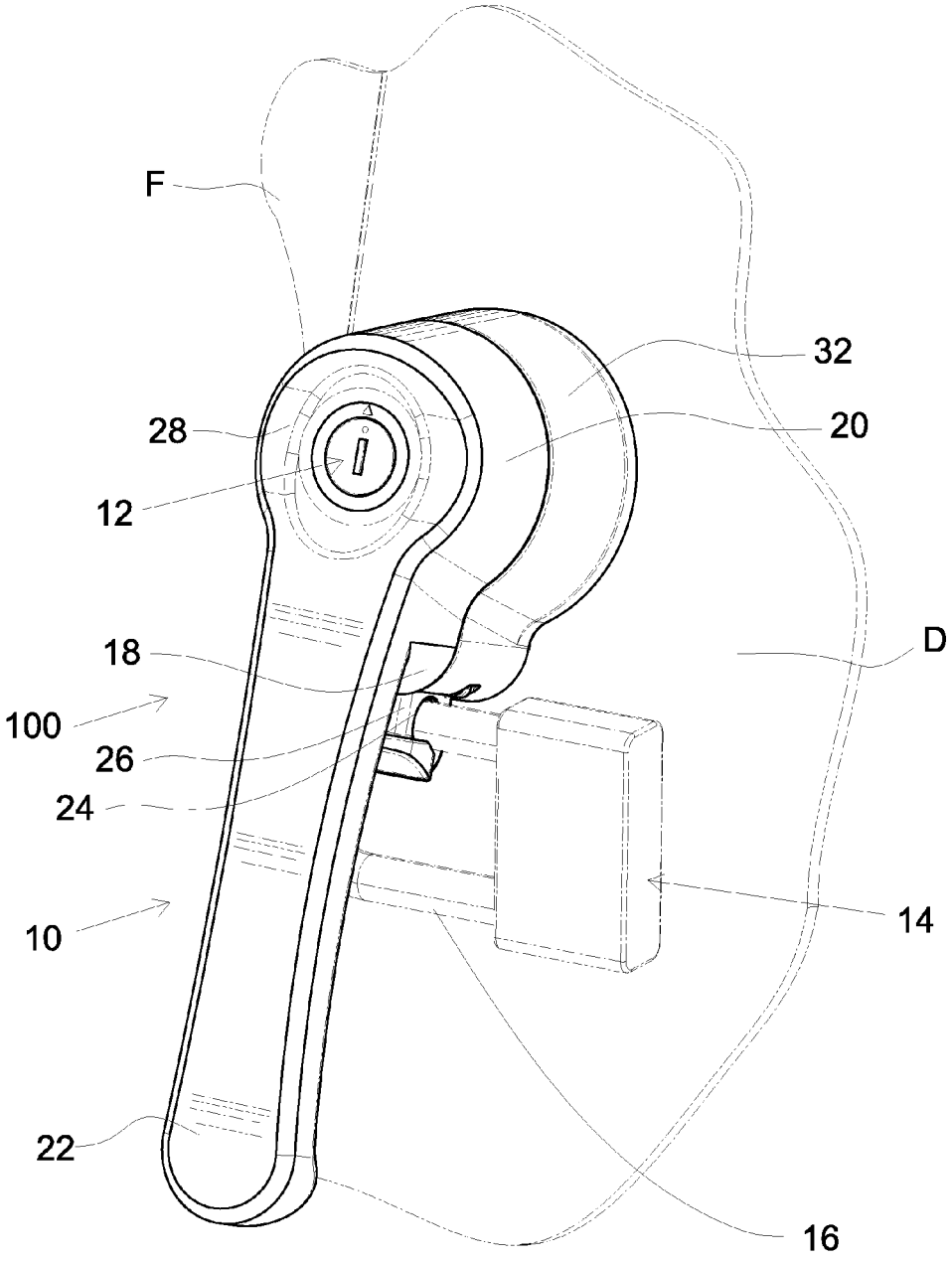
FIG. 1A is a front right isometric view of an exemplary embodiment the defeater latch handle with internal key lock cylinder of the invention with a padlock locked in place.

Turning first to FIG. 1A, there is shown a front right isometric view of an exemplary embodiment the defeater latch handle with internal key lock cylinder 100. A defeater latch handle 10 receives an internal key lock cylinder 12. A padlock 14 (shown in phantom) can be used to further secure locking of the defeater latch handle with internal key lock cylinder 100. The padlock is shown with its U-shaped bolt 16. The handle 10 includes a base 20 and a grip portion 22. The base 20 has a trigger catch portion 18, the purpose of which is described below. The U-shaped bolt 16 passes through a trigger hole 24 formed in a trigger 26. The handle 10 further has a head 28 on the base 20. The head 28 is adapted to provide access to the internal key lock cylinder 12 so that users can operate the internal key lock cylinder 12 with a key (not shown.) The base 20 of the handle 10 interfaces with an escutcheon 32. The escutcheon 32 of the defeater latch handle with internal key lock cylinder 100 is mounted on the outside of a door D that is adjacent to a door frame F.

Figure 1B:
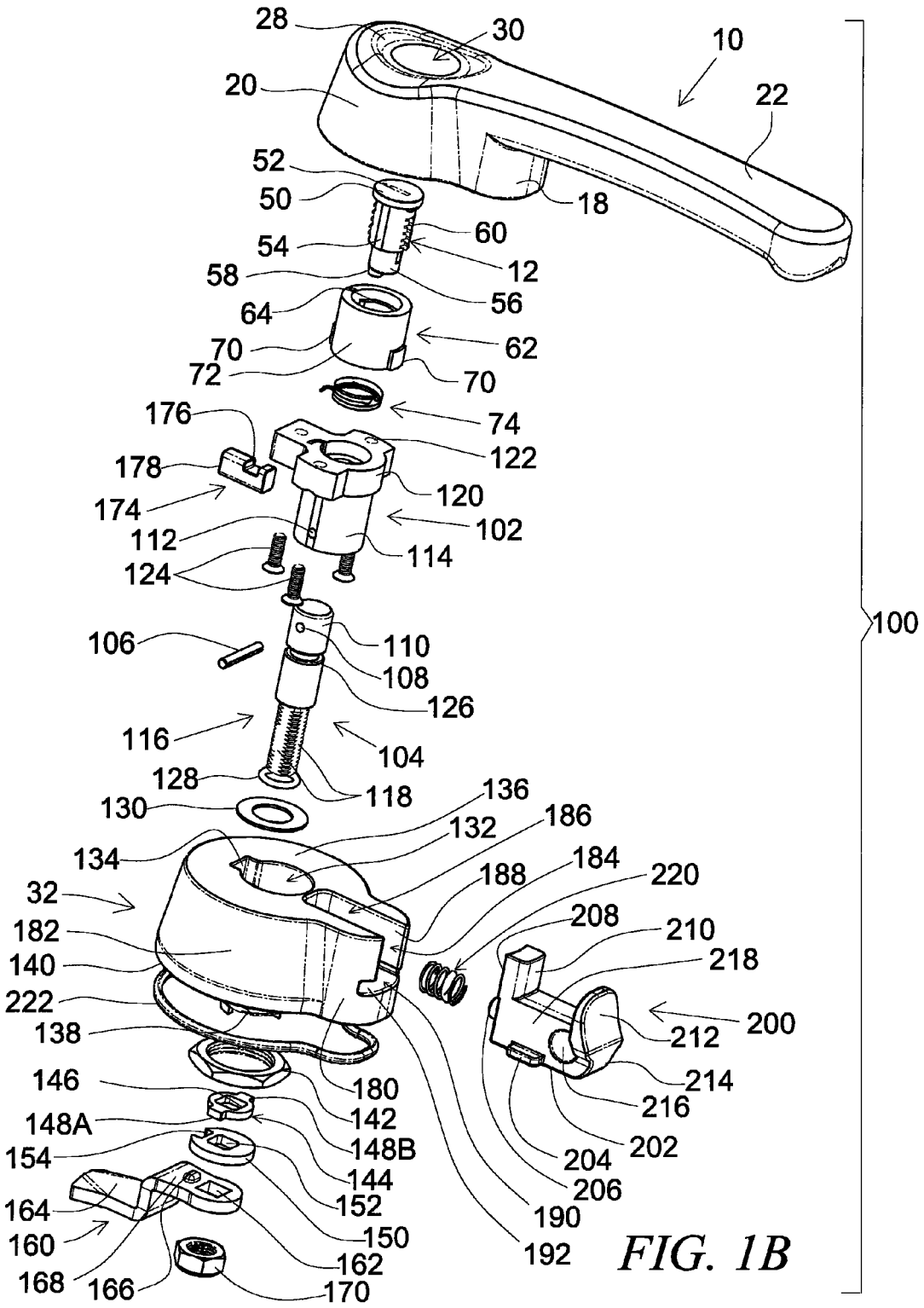
FIG. 1B is a fully exploded side view of an exemplary embodiment the defeater latch handle with internal key lock cylinder of the invention.
Figure 1C:
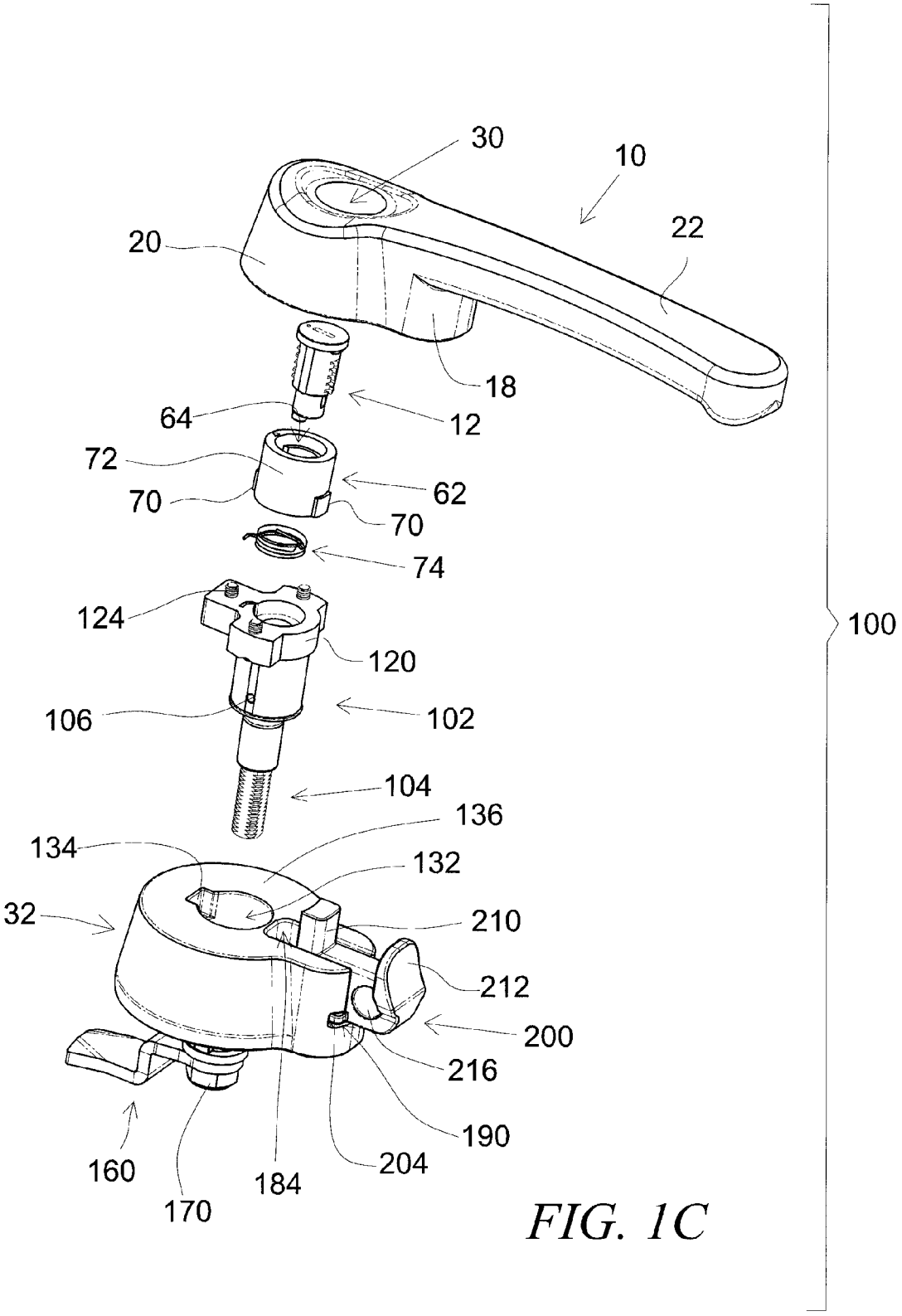
FIG. 1C is a partially exploded side view of an exemplary embodiment the defeater latch handle with internal key lock cylinder of the invention.
Figure 1D:
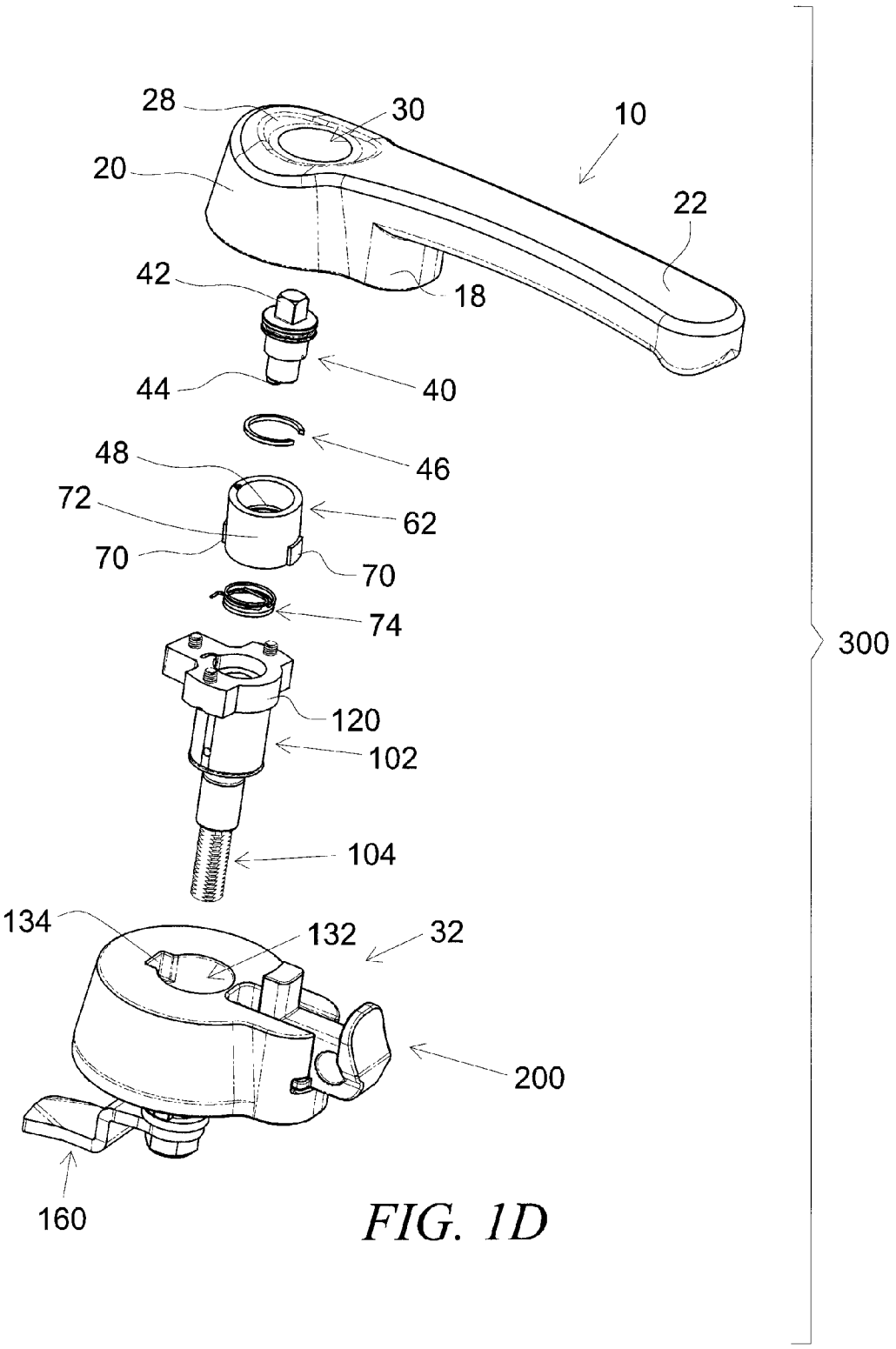
FIG. 1D is a partially exploded side view of an exemplary embodiment the defeater latch handle with turnable cylinder of the invention.
Figure 1E:
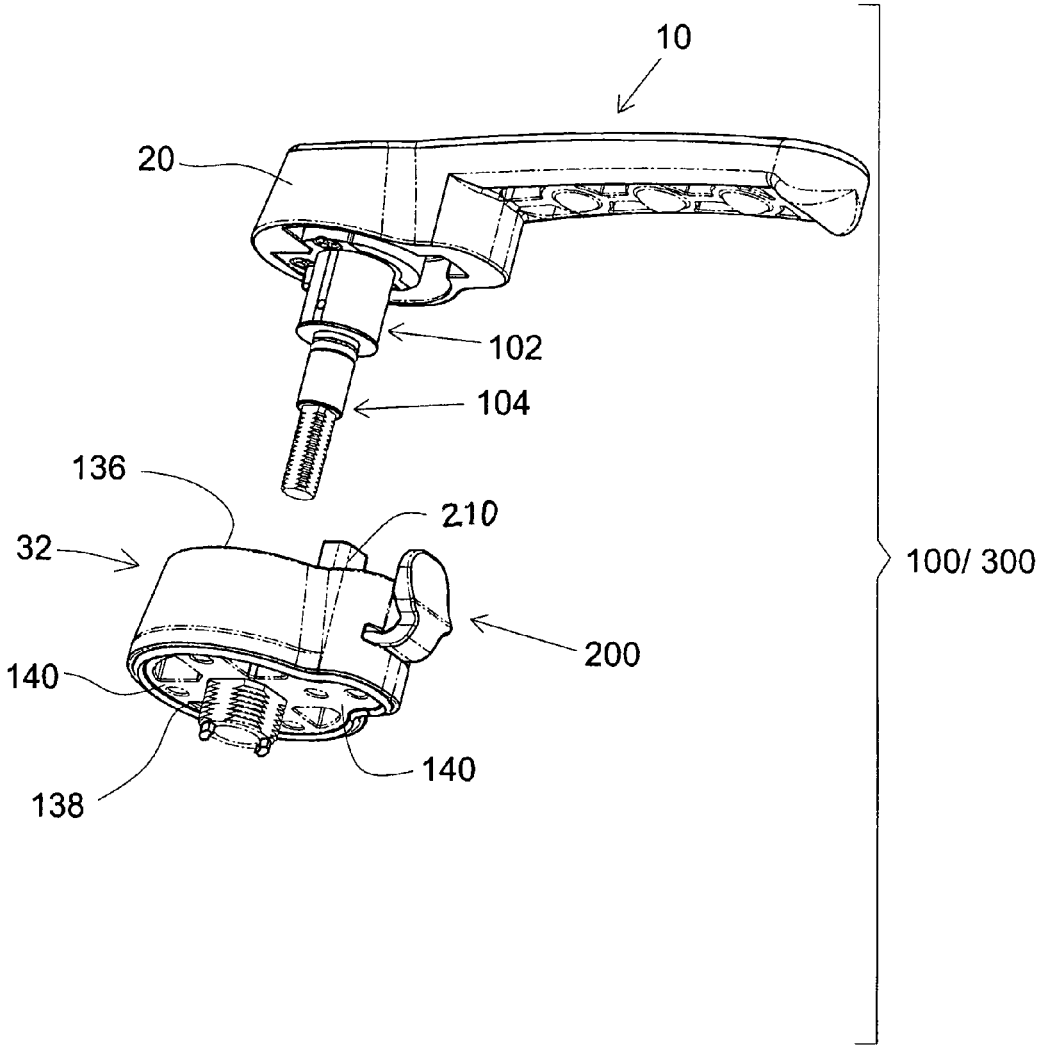
FIG. 1E is isometric bottom view showing the handle portion separated from the escutcheon portion of the exemplary embodiment the defeater latch handle with internal key lock cylinder and defeater latch handle with turnable cylinder of the invention.

FIG. 1B is a fully exploded side view of an exemplary embodiment the defeater latch handle with an internal key lock cylinder 100 of the invention. FIG. 1C is a partially exploded side view of an exemplary embodiment the defeater latch handle with internal key lock cylinder 100 of the invention, with the parts in the escutcheon 32 and below shown brought together. FIG. 1D is a partially exploded side view of an exemplary embodiment the defeater latch handle with a turnable cylinder 40 of the invention. FIG. 1D shows its defeater latch handle 300 in a similar state of assembly as the defeater latch handle 100 of FIG. 1C, but includes a turnable cylinder 40 instead of an internal lock cylinder 12. Except for there being a turnable cylinder 40 compared to the internal key lock cylinder 12 in the defeater latch handle 100 of FIG. 1C, the defeater latch handles 100 and 300 are the identical, and the description herein applies to both. FIG. 1E is isometric bottom view showing the handle portion 10 separated from the escutcheon portion 32 of the exemplary embodiment the defeater latch handle with an internal key lock cylinder 100 and defeater latch handle 300 of the invention.

Figure 1F:
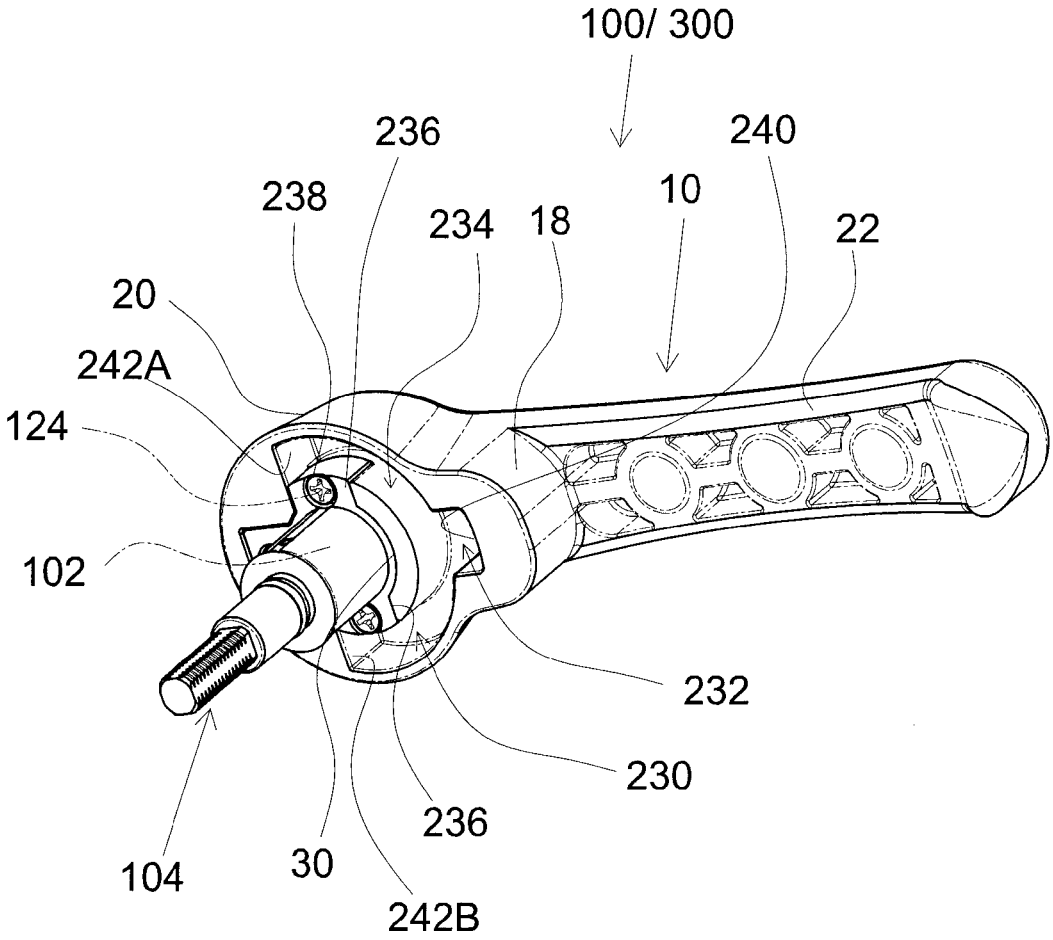
FIG. 1F is a rear isometric view of the assemble handle and shaft portion.
Figure 8:
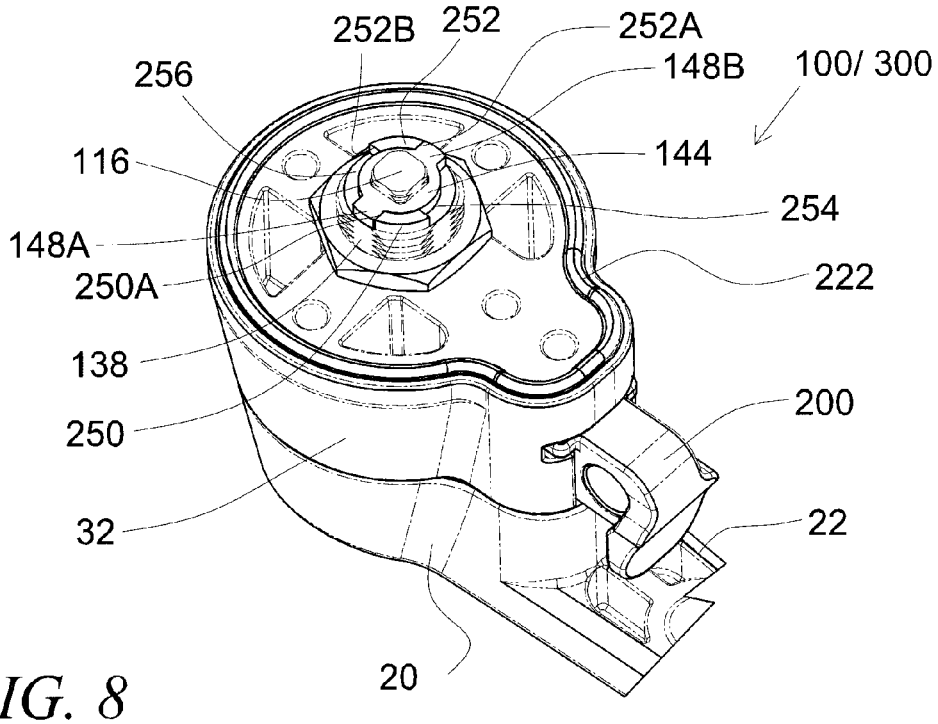
FIG. 8 is a rear right isometric view showing of the defeater latch handle of FIG. 1A with its turn direction keyed washer in a second orientation on the shaft.
Figure 7:
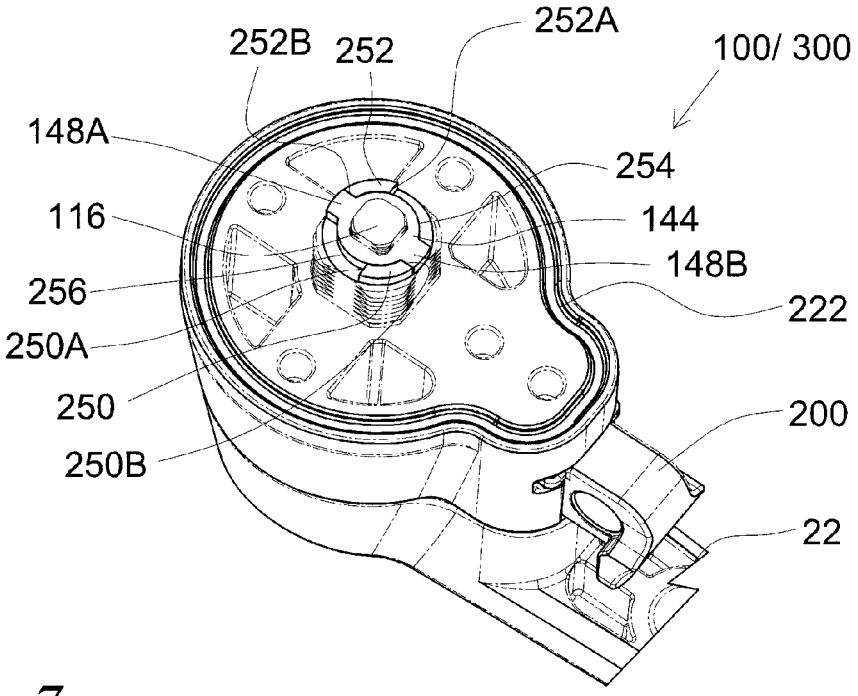
FIG. 7 is a rear right isometric view showing of the defeater latch handle of FIG. 1A with its turn direction keyed washer in a first orientation on the shaft.

Turning to FIG. 1B, the head 28 of the handle 10 has a cylinder hole 30 formed therein which is adapted to receive the internal key lock cylinder 12 or the turnable cylinder 40. FIG. 1C is a partially exploded side view of an exemplary embodiment the defeater latch handle with internal key lock cylinder 12 of the invention, with the parts in the escutcheon 32 and parts of the handle insert 102 and shaft 104 brought together. The shaft 104 can be provided in different lengths as may be required to meet the needs of any particular application. The internal key lock cylinder 12 has a lock head 50 at its top with key slot 52 for passage of the key (not shown), a cylindrical body 54, a turning base 56, and a non-round cam end 58. Spring loaded clips 60 extend around the cylindrical body 54. A plug insert 62 with a through hole 64 is provided to receive the internal key lock cylinder 12 in the through hole 64. As shown in FIG. 2B, the through hole 64 has reliefs 66 formed on inside walls 68 of the through hole 64, which reliefs 66 are designed to engage the spring loaded clips 60 when the internal key lock cylinder 12 is inserted into the through hole 64 of the plug insert 62. The plug insert 62 has protrusions 70 formed around it outer perimeter 72. A spring 74 is provided to bias the internal key lock cylinder 12 and connected parts to its lock state. The defeater latch handle with an internal key lock cylinder 100 and the defeater latch handle with turnable key lock cylinder 300 both include a handle insert 102, and a shaft 104 which is preferably detachably attached to the handle insert, e.g., by a pin 106 which passes through a pin hole 108 in a top part 110 of the shaft 104 and an aligned hole 112 formed in a bottom end 114 of the handle insert 102. The shaft 104 has a threaded lower end 116 and is preferably non-round (e.g., such as having flat sides 118). The handle insert 102 has an upper end 120 with screw holes 122 through which screws 124 will pass and screw into the base 20 of the handle 10 to retain the handle insert 102 and its carried shaft 104 to the handle 10. Thus, when the handle 10 is turned, the handle insert 102 and shaft 104 will likewise turn. Below the top part 110 of the shaft a groove 126 can be provided to receive a seal, such as an O-ring 128. A gasket 130 is provided. The escutcheon 32 has a bore 132 with a notch 134 formed through its top surface 136. The bore 132 passes through a threaded extension 138 that extends below a bottom surface 140 of the escutcheon 32. As best shown in FIGS. 9A, 9B, 10A, and 10B, the bore 132 has an upper portion 132A that is generally cylindrical and sized to receive the cylindrical bottom end 114 of the handle insert 102, and a lower portion 132B that is generally cylindrical and sized to receive the top part 110 of the shaft 104. At the upper end of the upper portion 132A the notch 134 extends outside of the generally cylindrical confines of the bore 132. A threaded extension nut 142 is provided to screw onto the threaded extension 138. A turn direction keyed washer 144 has a non-round hole 146 that is complementary to the threaded lower end 116 with flat sides 118 of the shaft 104. The turn direction keyed washer 144 has two ears 148A and 148B at opposite ends thereof. As best shown in FIGS. 7 and 8, the turn direction keyed washer 144 will slide onto the threaded lower end 116 of the shaft 104 in two possible orientations, and will function to control whether the defeater latch handle will operate by being turned clockwise, or counterclockwise, as will be discussed further below. A cam engaging washer 150 with a non-round hole 152 is also provided that slides onto the threaded lower end 116 with flat sides 118 of the shaft 104. The cam engaging washer 150 has a notch 154 at one side. A lock cam 160 is provided and has a non-round hole 162 that slides onto the threaded lower end 116 of the shaft 104. The lock cam 160 has an extension arm 164 that is adapted engage with a catch on door frame (not shown). A protrusion 166 can be formed on a lever portion 168. When the lock cam 160 is positioned on the threaded lower end 116 of the shaft 104, the protrusion 166 will engage with the notch 154 of the cam engaging washer 150 and further help retain it in position. Finally, the cam 160 is retained in place with a cam nut 170. The lock cam 160 can be placed on the threaded lower end 116 of the shaft 104 in a desired orientation. By selecting a lock cam 160 with the desired dimensions, the defeater latch handle 100 or 300 can be customized to fit a wide variety of requirements, such as having an extra deep setback or throw. Associated with the handle insert 102 is a block bar 174. The block bar 174 has a cutout 176 formed on an upper surface, and has a protruding end 178. Referring back to the escutcheon 32, it has a wedge extension 180 that extends from the sidewall 182 thereof. A horizontal upside down T-shaped slot 184 partially extends into the wedge extension 180 towards the bore 132 formed therein, but does not intersect the bore 132. The upside down T-shaped slot 184 has a narrower upper portion 186 defined by upper slot sidewalls 188 and a wider lower portion 190 with a floor 192. The horizontal upside down T-shaped slot 184 is adapted to receive a slidable trigger 200. The slidable trigger 200 has a bottom surface 202 with extensions 204 that are slidably captured in the wider lower portion 190 with floor 192 of the upside down T-shaped slot 184. The slidable trigger 200 has a spring catch 206 on its back wall 208, has an extension catch 210 that rises up near the back wall 208, has a trigger grip 212 at its front end 214, and has a lock hasp hole 216 formed through its sidewalls 218. When assembled, a spring 220 fits onto the spring catch 206 on its back wall 208 of the slidable trigger 200 and is received in the horizontal upside down T-shaped slot 184. This will bias the slidable trigger 200 outwardly from the slot 184. The extension catch 210 extends upwardly above the top surface 136 of the escutcheon 32. Lastly, a gasket 222 can be provided to provide for improved sealing between the escutcheon 32 and a door to which it will be affixed. As best shown in FIGS. 4, 3B, 3C, 4, 7, and 8, the gasket 222 (such as having a round cross-section) fits into a groove 224 formed in the bottom surface 140 of the escutcheon 32. As noted above, FIG. 1C is a partially exploded side view of the exemplary embodiment the defeater latch handle with an internal key lock cylinder 100 of the invention, with the parts in the escutcheon 32 and below shown brought together, and with the handle insert 102 and shaft 104 attached. In this view, the slidable trigger 200 is received in the horizontal upside down T-shaped slot 184, and the extensions 204 ride in the wider lower portion 190. The extension catch 210 extends above the level of the top surface 136 of the escutcheon 32, and as will be described further below with respect to FIG. 1F, is adapted to be received in a recess 230 formed in the underside of the trigger catch portion 18 and base 20 of the handle 10, which recess 230 has a notch portion 232 that extends into the trigger catch portion 18 and a semi-circular ring portion 234 of the recess 230 formed in the underside of the base 20. The notch portion 232 of the trigger catch portion 18 has an outer edge 240.

Also formed in the underside of the base 20 is a handle insert cavity 236 sized and shaped to receive the upper end 120 of the handle insert 102. Screw holes 238 are positioned to receive the screws 124. In the locked position of the handle 10 relative to the escutcheon, the slidable trigger 200 is pushed out by the spring 220 so that its extension catch 210 will be received in the notch portion 232 of the recess 230. This prevents the handle 10 from being turned. When the slidable trigger 200 is pushed inwardly all the way in opposition to the spring 220, its extension catch 210 will be positioned in the semi-circular ring portion 234. Assuming the cylinder lock 12 or turnable cylinder 40 are also rotated by a user to their unlocked position, the handle 10 can then be rotated, thereby bringing the extension catch 210 into a position of the semi-circular ring portion 234 not in line with the notch portion 232.

FIG. 1D is a partially exploded side view of an exemplary embodiment the defeater latch handle with a turnable cylinder 300 of the invention. FIG. 1D shows its defeater latch handle 300 in a similar state of assembly as the defeater latch handle 100 of FIG. 1C, but includes a turnable cylinder 40 instead of an internal lock cylinder 12. This embodiment is identical to the embodiment of the defeater latch handle with internal key lock cylinder with internal key lock cylinder 100 of FIG. 1A except that instead of incorporating an internal key lock cylinder 12 that is operated with a key, it uses a turnable cylinder 40. FIG. 1D shows the turnable cylinder 40 as having a rectangular head 42 for turning, but which turnable cylinder 40 can be operated by turning it with any desired type of tool, such as a driver (flat, crosshead, Allen, star drive), or the turnable cylinder 40 can include a head that is graspable by a user's fingers (not shown.) Opposite the rectangular head 42 is a non-round cam end 44. The same references used with reference to the defeater latch handle with internal key lock cylinder 100 of FIGS. 1B and 1C are used. The handle 10 has a grip portion 22, and a head 28 on the base 20. The head 28 with a cylinder hole 30 that is adapted to provide access to the turnable cylinder 40, viz., so users can operate the turnable cylinder 40 with a screwdriver (not shown.) The base 20 of the handle 10 interfaces with an escutcheon 32. The escutcheon 32 of the defeater latch handle with turnable cylinder 300 is mounted on the outside of a door adjacent to a door frame 36, neither shown. A spring clip 46 fits around the turnable cylinder 40 and rotatably retains it in groove 48 formed inside a plug insert 62.

FIG. 1E is isometric bottom view showing the handle portion 10 separated from the escutcheon portion 32 of the exemplary embodiment the defeater latch handle with an internal key lock cylinder 100 and defeater latch handle with a turnable cylinder 300 of the invention. In this view, the handle insert 102 is engaged with the shaft 104 and both are attached with the base 20 of the handle 10, and slidable trigger 200 is engaged with the escutcheon 32. The top surface 136 and bottom surface 140 are shown, with the threaded extension 138 extended from the bottom surface 140. The extension catch 210 of the slidable trigger 200 is shown extending above the top surface 136 of the escutcheon 32.

FIG. 1F is a rear isometric view of the assemble handle and shaft portion of the defeater latch handle with an internal key lock cylinder 100 and defeater latch handle with a turnable cylinder 300 of the invention. The handle 10, trigger catch portion 18, base 20, grip portion 22, and cylinder hole 30 are shown with the handle insert 102 and its attached shaft 104 attached to the base 20 with screws 124. The recess 230 formed in the underside of the trigger catch portion 18 and base 20 of the handle 10, which recess 230 has a notch portion 232 that extends into the trigger catch portion 18 and a semi-circular ring portion 234 of the recess 230 formed in the underside of the base 20. Also formed in the underside of the base 20 is a handle insert cavity 236 side to receive the upper end 120 of the handle insert 102. Screw holes 238 are positioned to receive the screws 124. The semi-circular ring portion 234 has terminal ends 242A and 242B. As explained with reference to FIGS. 9B and 10B, these terminal ends 242A and 242B, in connection with the extension catch 210 of the slidable trigger 200, prevent over-rotation of the handle 10 relative to the escutcheon 32.

Figure 2A:
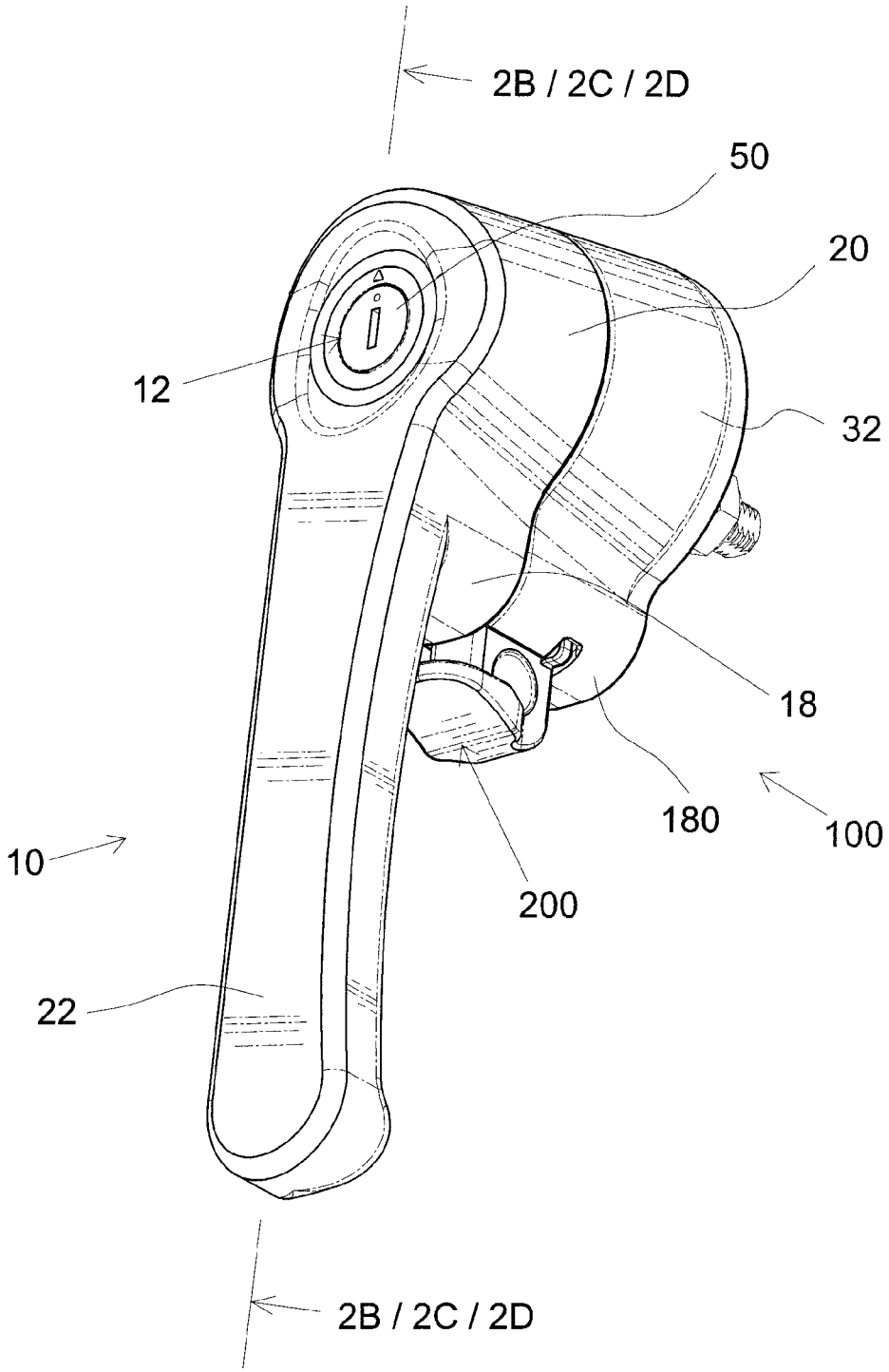
FIG. 2A is a lower front right isometric view of an exemplary embodiment the defeater latch handle of FIG. 1A without a padlock and in a locked state.
Figure 2B:
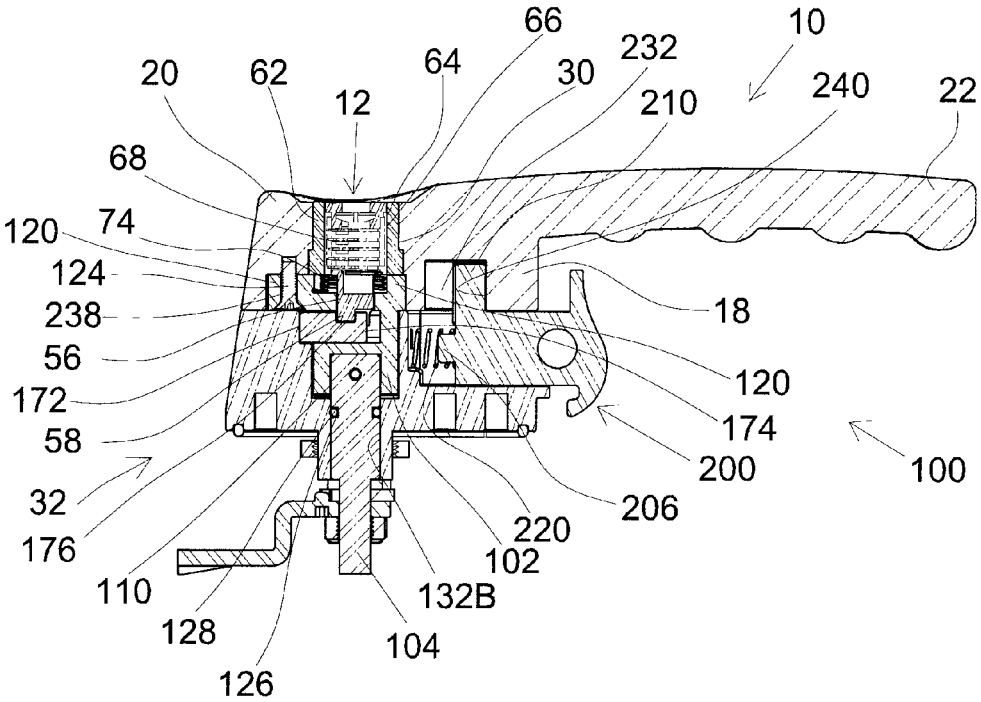
FIG. 2B is a cross-sectional view of the defeater latch handle through view lines 2B-2B of FIG. 2A, with the trigger undepressed and the key cylinder locked.

FIG. 2A is a lower front right isometric view of the defeater latch handle with internal key lock cylinder 100 of FIG. 1A, without a padlocked and in a locked state, with the trigger 200 undepressed and the key cylinder 12 locked. The trigger catch portion 18, base 20, and grip portion 22 of the handle 10 are aligned with the escutcheon 32, such that the trigger 200 extends out of the wedge extension 180 of the escutcheon 32 and engages with the trigger catch portion 18.

Figure 2C:
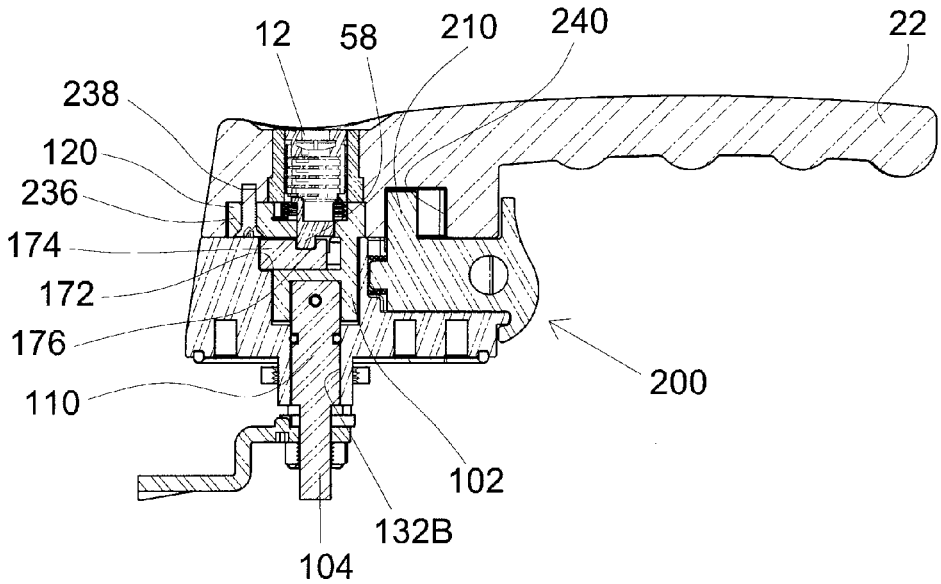
FIG. 2C is a cross-sectional view of the defeater latch handle through view lines 2C-2C of FIG. 2A, with the trigger depressed and the key cylinder locked.
Figure 2D:
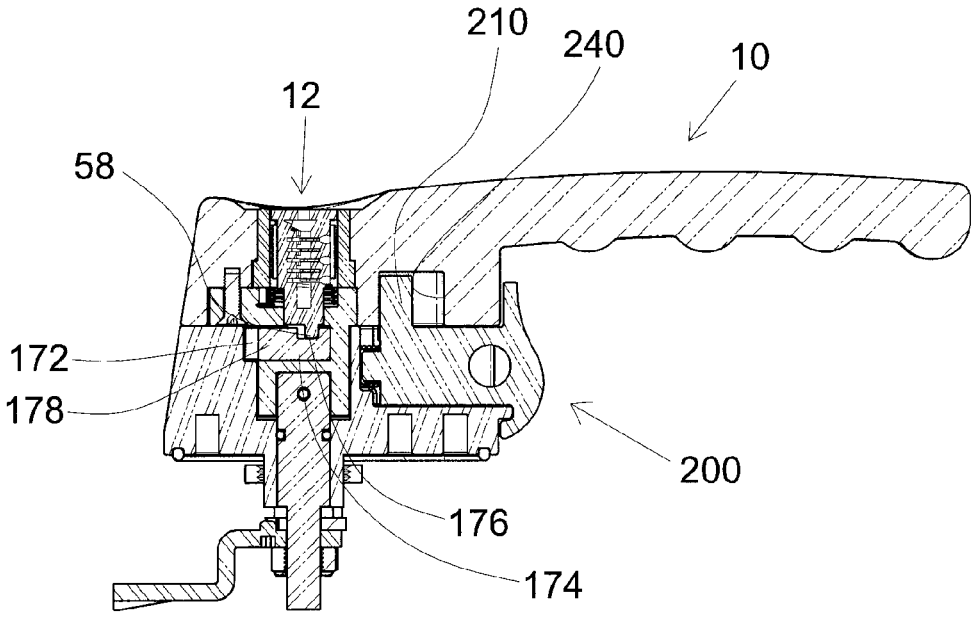
FIG. 2D is a cross-sectional view of the defeater latch handle through view lines 2D-2D of FIG. 2A, with the trigger depressed and the key cylinder unlocked.

FIG. 2B is a cross-sectional view of the defeater latch handle 100 through view lines 2B-2B of FIG. 2A, with the trigger 200 is undepressed and the key cylinder 12 locked. FIG. 2C is a cross-sectional view of the defeater latch handle 100 through view lines 2C-2C of FIG. 2A, with the trigger 200 depressed and the key cylinder 12 still locked. Finally, FIG. 2D is a cross-sectional view of the defeater latch handle 100 through view lines 2D-2D of FIG. 2A, with the trigger 200 depressed and the key cylinder 12 unlocked. The internal key lock cylinder 12 is shown with its a turning base 56 and non-round cam end 58 extending through the plug insert 62, which plug insert it fitted into the cylinder hole 30 in the head 20 of the handle 10. As best shown in FIG. 3B, the through hole 64 has reliefs 66 formed on inside walls 68 of the through hole 64, which reliefs 66 are designed to engage the spring loaded clips 60 when the internal key lock cylinder 12 is inserted into the through hole 64 of the plug insert 62. Turning back to FIGS. 2B-2D, the spring 74 is provided to bias the internal key lock cylinder 12 to its locked state. The upper end 120 of the handle insert 102 attached with screws 124 to the base 20 of the handle 10 to retain the handle insert 102 and its carried shaft 104 to the handle. Thus, when the handle is turned, the handle insert 102 and shaft 104 will likewise turn. The O-ring 128 fits in the groove 126 to establish a seal to prevent water from passing into to the handle latch through the bore 132 in the escutcheon 32. As best shown in FIGS. 3B-3E, the bore 132 has an upper portion 132A that is generally cylindrical and sized to receive the cylindrical bottom end 114 of the handle insert 102, and a lower portion 132B that is generally cylindrical and sized to receive the top part 110 of the shaft 104. The handle insert 102 has in its upper end 120 a channel 172 formed therein that is designed to slidably receive the block bar 174. As can be seem the non-round cam end 58 of the lock cylinder 12 fits into cutout 176 formed in the block bar 174. When the lock cylinder 12 is unlocked, the non-round cam end 58 spins around from position shown in FIG. 2B where the blocking bar 174 is moved to the far right end of the channel 172, to the position shown in FIG. 2C, where the blocking bar 174 is moved to the far left end of the channel 172, in which case the protruding end 178 of the blocking bar 174 will not interfere with rotation of the handle 10. Turning back to FIG. 2B, in this position, the slidable trigger 200 is undepressed and the key cylinder 12 locked, and the trigger 200 and its extension catch 210 are biased by the spring 220 which fits on the spring catch 206 into contact with the outer edge 240 of the notch portion 232 of the trigger catch portion 18. In this state, the trigger 200 independently prevents rotation of the handle 10 regardless of the state of the key lock 12. In FIG. 2C, the trigger 200 is shown pushed inwardly away from the outer edge 240 of the notch portion 232 of the trigger catch portion 18. In this state, the extension catch 210 will not otherwise block rotation of the handle but for the key lock 12 still being in its locked position, wherein the blocking bar 174 is in its locked position. Lastly, in FIG. 2D, the defeater latch handle with internal key lock cylinder 100 is shown with both its key lock 12 and trigger 200 moved to their unlocked position, which will allow a user to turn the handle 10

Figure 3A:
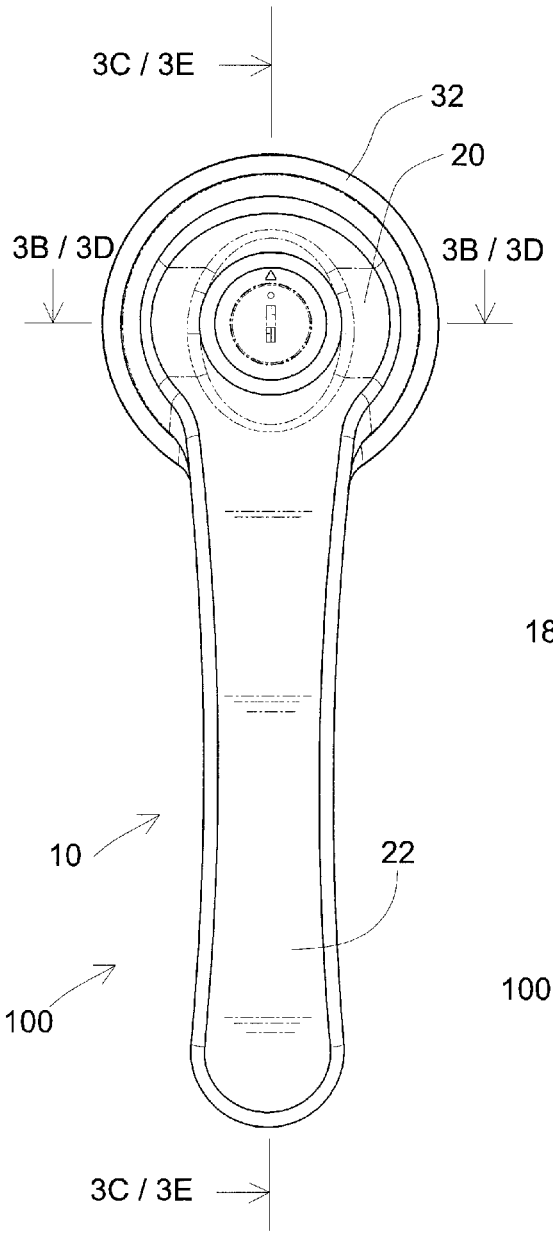
FIG. 3A is a front plan view of the defeater latch handle with internal key lock cylinder of FIG. 1A.
Figure 4:
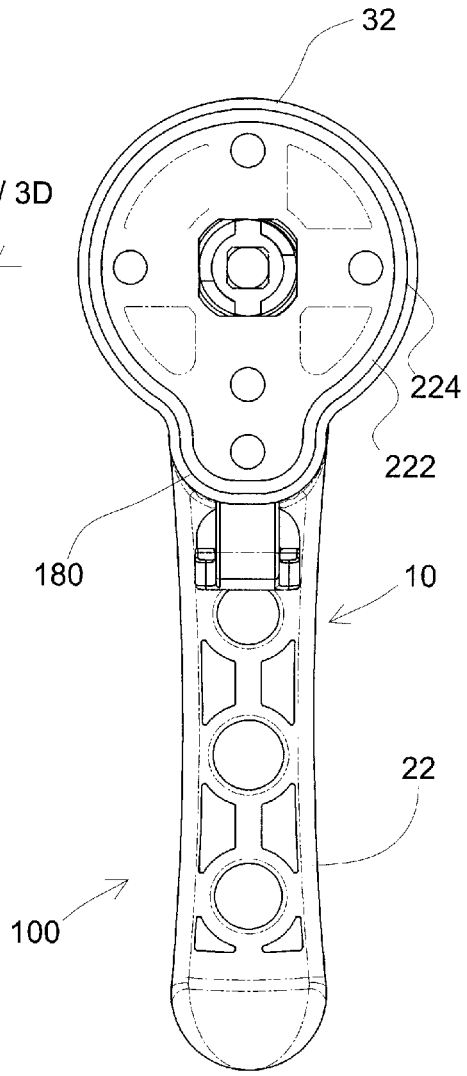
FIG. 4 is a rear plan view of the defeater latch handle with internal key lock cylinder of FIG. 1A.

Turning to FIGS. 3A and 4, there are shown a front plan view and rear plan view, respectively, of the defeater latch handle with internal key lock cylinder 100. The handle 10, trigger catch portion 18, handle base 20 and grip portion 22, and escutcheon 32 with wedge extension 180, the gasket 222 in the groove 224 are shown.

Figure 3C:
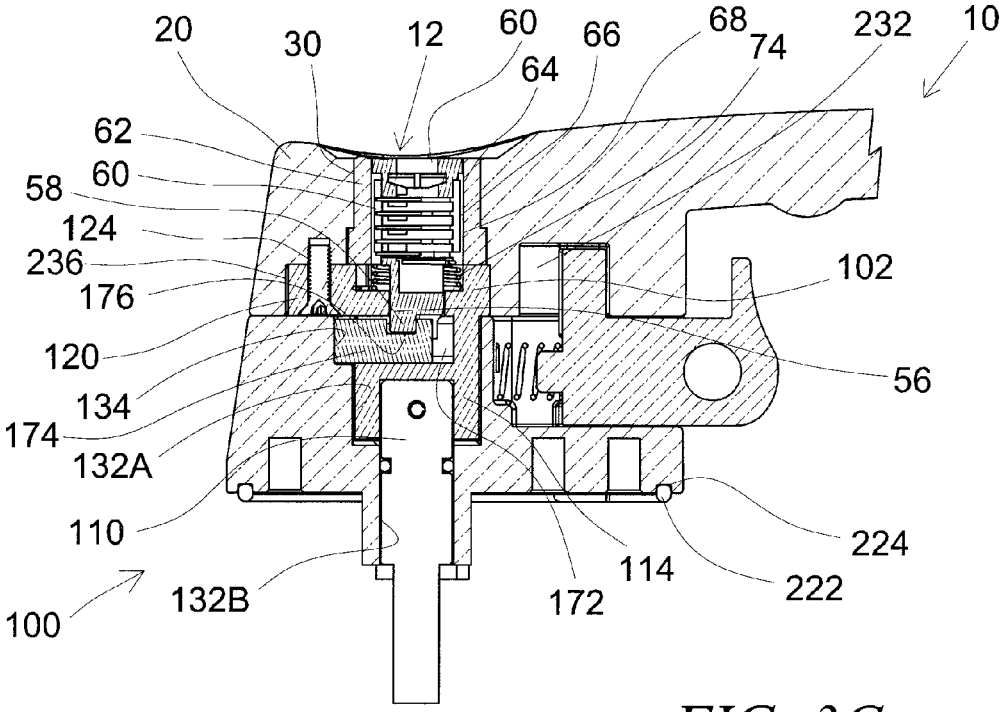
FIG. 3C is a cross-sectional view through view lines 3C-3C of FIG. 3A showing the defeater latch handle with internal key lock cylinder of the invention.
Figure 3B:
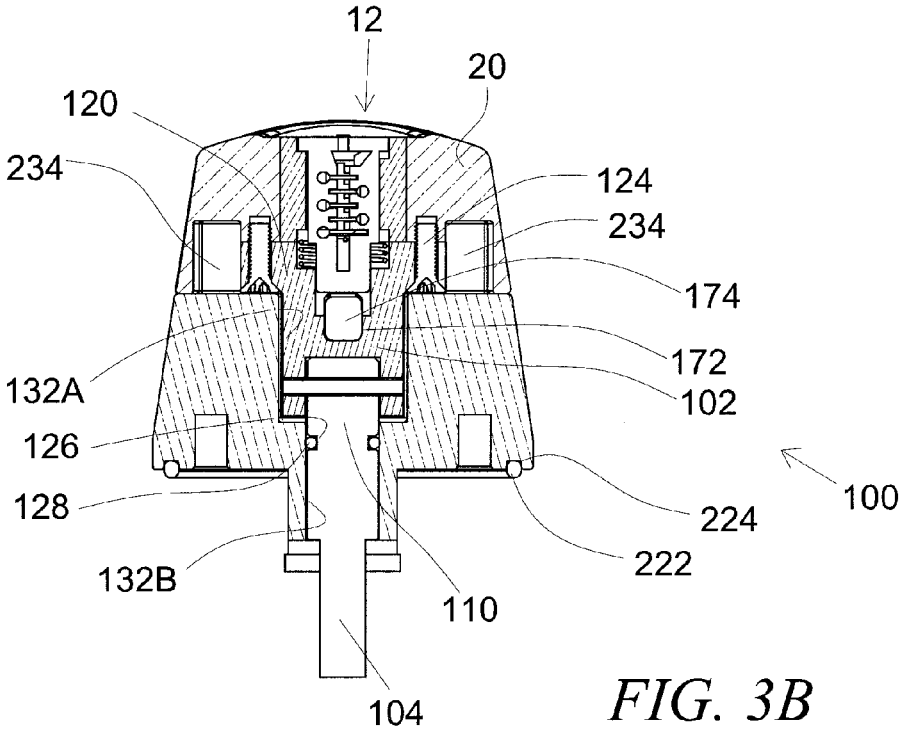
FIG. 3B is a cross-sectional view through view lines 3B-3B of FIG. 3A showing the defeater latch handle with internal key lock cylinder of the invention.

FIG. 3B is a cross-sectional view through view lines 3B-3B of FIG. 3A showing the defeater latch handle with internal key lock cylinder 100, and FIG. 3C is a cross-sectional view through view lines 3D-3C of FIG. 3A showing the defeater latch handle with internal key lock cylinder 100. The internal key lock cylinder 12 is shown with its a turning base 56 and non-round cam end 58 extending through the plug insert 62, which plug insert 62 it fitted into the cylinder hole 30 in the head 20 of the handle 10. The through hole 64 has reliefs 66 formed on inside walls 68 of the through hole 64, which reliefs 66 are designed to engage the spring loaded clips 60 when the internal key lock cylinder 12 is inserted into the through hole 64 of the plug insert 62. The spring 74 is provided to bias the internal key lock cylinder 12 to its locked state. The upper end 120 of the handle insert attached with screws 124 within the handle insert cavity 236 in the base 20 of the handle 10 to retain the handle insert 102 and its carried shaft 104 to the handle 10. Thus, when the handle 10 is turned, the handle insert 102 and shaft 104 will likewise turn. The O-ring 128 fits in the groove 126 to establish a seal to prevent water from passing into to the handle latch through the bore 132 in the escutcheon 32. The bore 132 has an upper portion 132A that is generally cylindrical and sized to receive the cylindrical bottom end 114 of the handle insert 102, and a lower portion 132B that is generally cylindrical and sized to receive the top part 110 of the shaft 104. The handle insert 102 has in its upper end 120 a channel 172 formed therein that is designed to slidably receive the block bar 174. As can be seem the non-round cam end 58 of the lock cylinder 12 fits into cutout 176 formed in the block bar 174. The notch portion 232 of the recess in the base 20 of the handle 10 is shown in FIG. 3C and portions of the semi-circular ring portion 234 are shown in FIG. 3B.

Figure 3E:
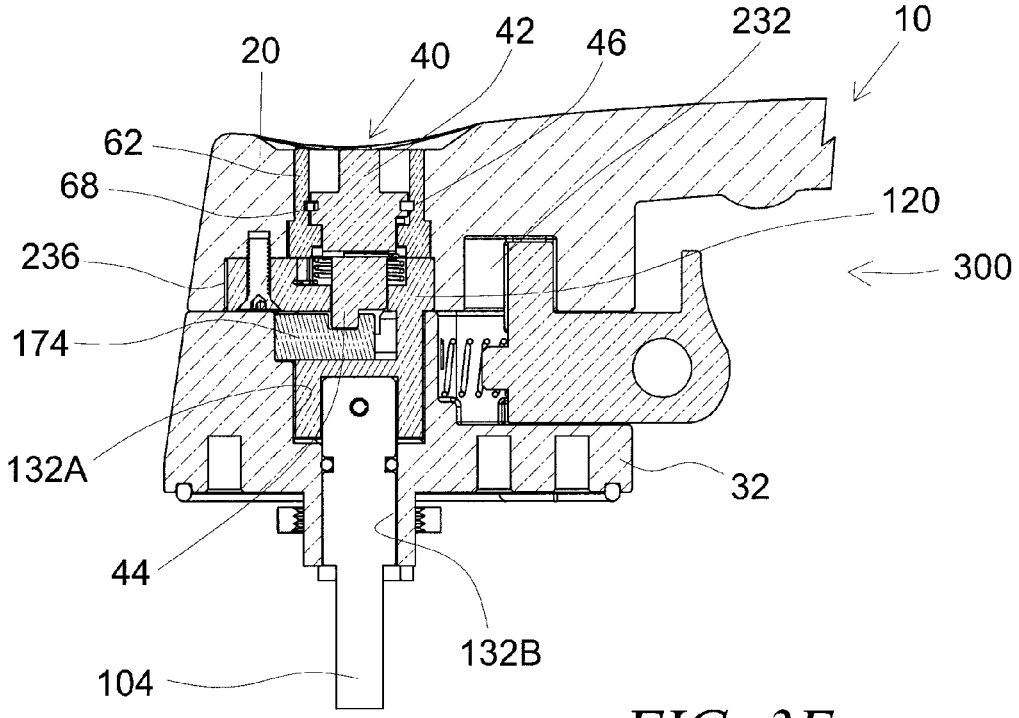
FIG. 3E is a cross-sectional view through view lines 3E-3E of FIG. 3A showing the defeater latch handle with a turnable cylinder of the invention.
Figure 3D:
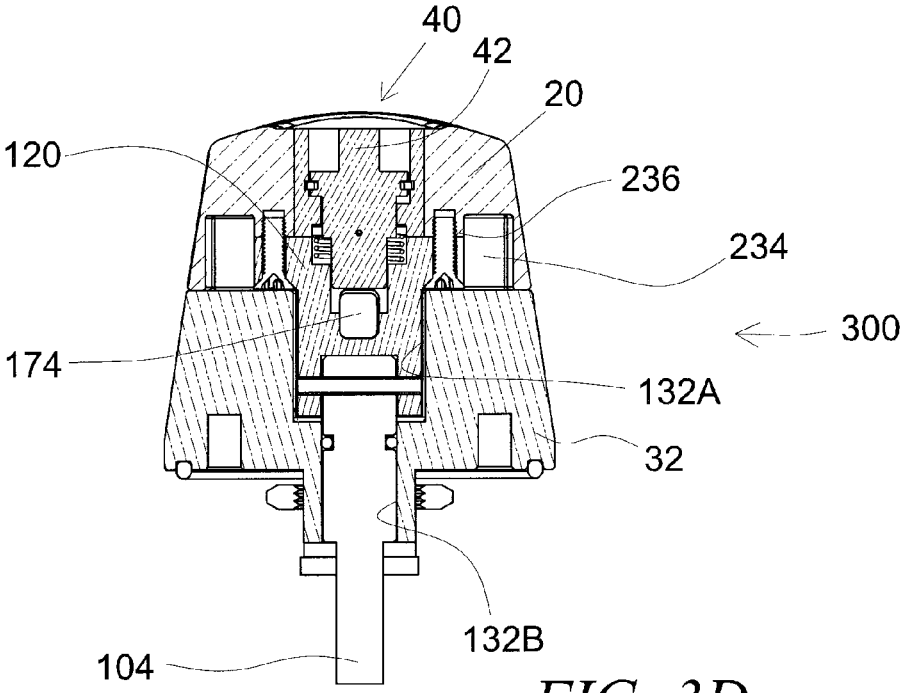
FIG. 3D is a cross-sectional view through view lines 3D-3D of FIG. 3A showing the defeater latch handle with a turnable cylinder of the invention.

FIG. 3D is a cross-sectional view through view lines 3D-3D of FIG. 3A showing the defeater latch handle with a turnable cylinder 300, and FIG. 3E is a cross-sectional view through view lines 3E-3E of FIG. 3A showing the defeater latch handle with a turnable cylinder 300. These views are identical to those of FIGS. 3B and 3C, except that the turnable cylinder 40 with rectangular head and the spring clip 46 fits around the turnable cylinder 40 and rotatably retains it in the groove 48 formed inside its plug insert 62. The non-round cam end 44 of the turnable cylinder 40 engages with the blocking bar 174 and functions the same as the defeater latch handle with an internal key lock cylinder 100. Other features are as previously described with respect to FIGS. 3B and 3C and are not repeated.

Figure 5:
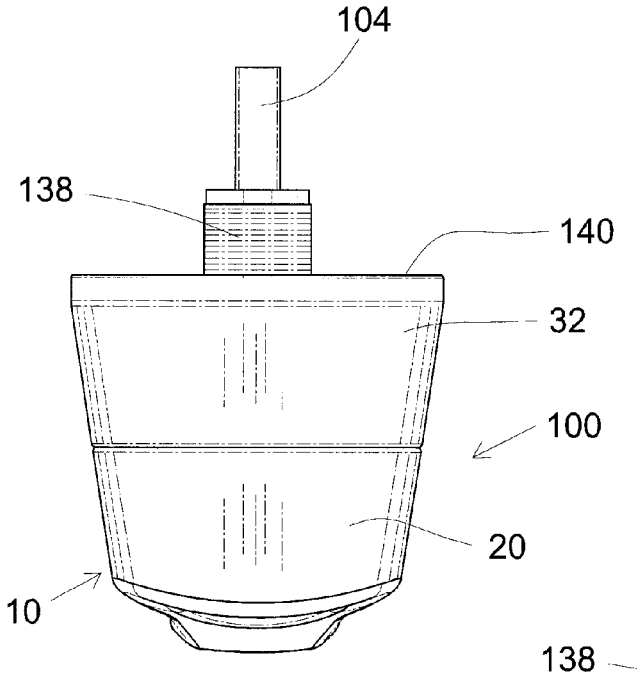
FIG. 5 is a top view of the defeater latch handle with internal key lock cylinder of FIG. 1A.
Figure 6:
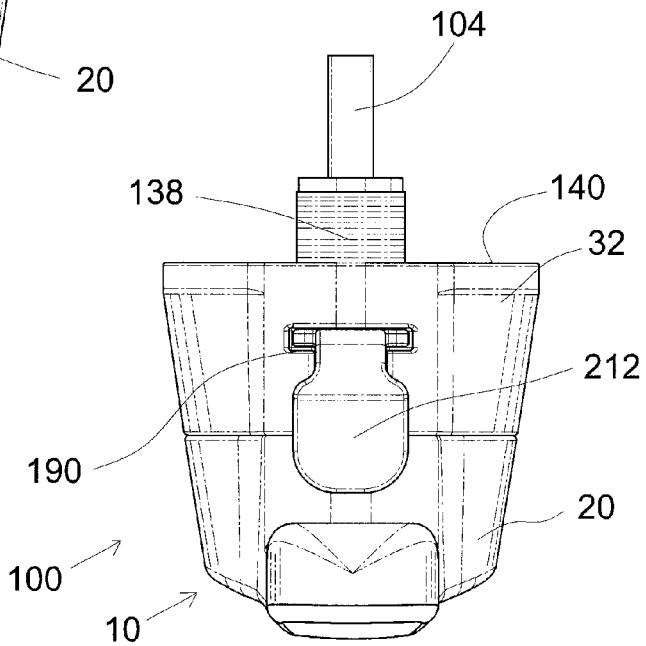
FIG. 6 is a bottom view of the defeater latch handle with internal key lock cylinder of FIG. 1A.

FIG. 5 is a top view and FIG. 6 is a bottom view of the defeater latch handle with internal key lock cylinder 100. The threaded extension 138 is shown extended from the bottom surface 140 of the escutcheon 32 with the shaft 104 protruding therethrough. The base 20 of the handle 10 sits on the escutcheon 32 and the trigger grip 212 is shown along with the wider lower portion 190 of the horizontal upside down T-shaped slot.

FIG. 7 is a rear right isometric view showing of the defeater latch handle 100/300 with its turn direction keyed washer 144 in a first orientation on the threaded lower end 116 of the shaft, and FIG. 8 is a rear right isometric view showing of the defeater latch handle 100/300 with its turn direction keyed washer 144 in a second orientation on the threaded lower end 116 of the shaft. The threaded extension 138 has at its terminal end two upwardly extending stops 250 and 252 that are opposite each other. Stop 250 has sides 250A and 250B and stop 252 has sides 252A and 252B. Between the two stops 250 and 252 are spaces 254 and 256. In FIG. 7, the turn direction keyed washer 144 is positioned on the threaded lower end 116 of the shaft such that its ear 148A abuts side 250B of stop 250 and its ear 148B abuts side 252B of stop 252. When the key lock 12 or the turnable cylinder 40 are unlocked, and the trigger 200 is depressed, the handle 10 can be rotated only clockwise by about one quarter turn. In contrast, in FIG. 8, the turn direction keyed washer 144 is positioned on the threaded lower end 116 of the shaft 104 such that its ear 148A abuts side 250A of stop 250 and its ear 148B abuts side 252A of stop 252. When the key lock 12 or the turnable cylinder 40 are unlocked, and the trigger 200 is depressed, the handle 10 can be rotated only counterclockwise by about one quarter turn. Thus, with the same defeater latch handle 100/300, by simply changing the orientation of the turn direction keyed washer 144 on the threaded lower end 116 of the shaft, the defeater latch handle 100/300 can be changed from a clockwise turn to open latch to a counterclockwise turn to open latch.

Figure 9A:
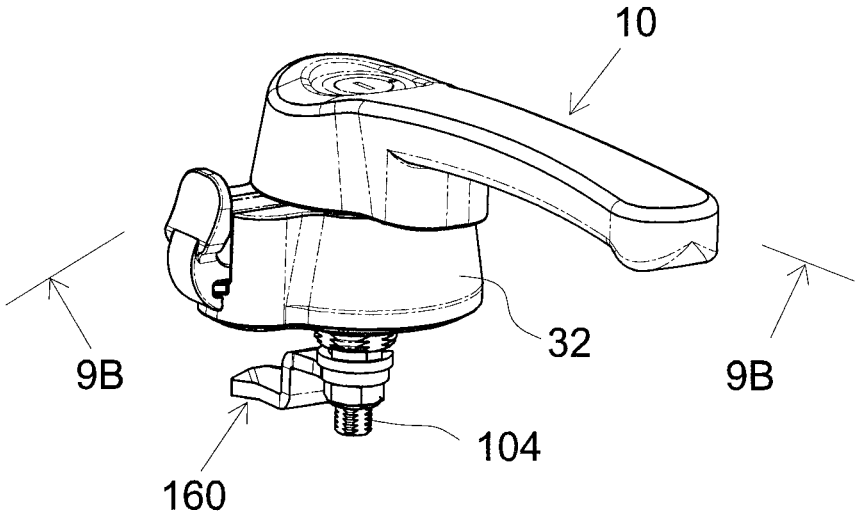
FIG. 9A is a front left isometric view showing the defeater latch handle of FIG. 1A unlocked and turned ¼ turn in a counterclockwise direction, as is permitted when the turn direction keyed washer is in the first orientation of FIG. 7.

FIG. 9A is a front left isometric view showing the defeater latch handle 100 unlocked and with its handle 10 turned ¼ turn in a counterclockwise direction relative to the escutcheon 32, as is permitted when the turn direction keyed washer 144 is in the first orientation of FIG. 7. This also rotates the shaft 104 and its attached lock cam 160.

Figure 9B:
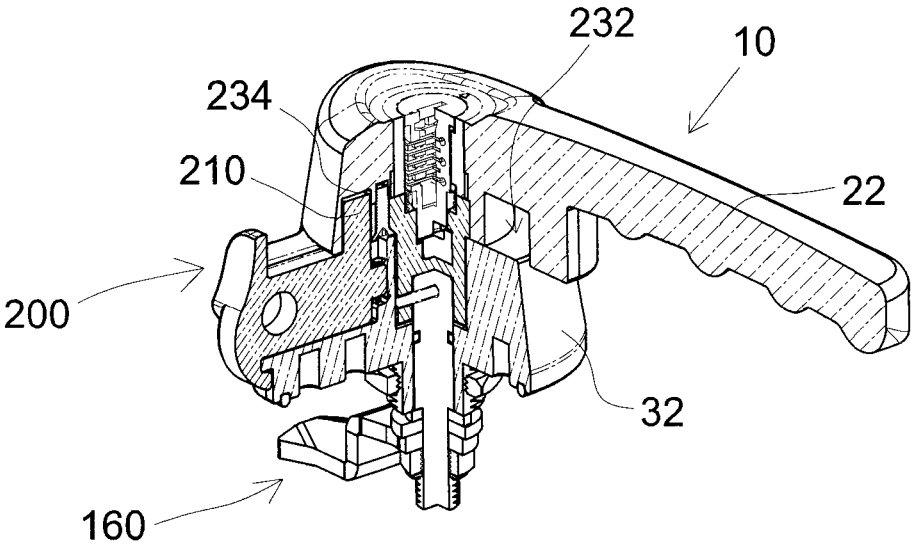
FIG. 9B is a side cross-sectional view through view lines 9B-9B of FIG. 9A.

FIG. 9B is a side cross-sectional view through view lines 9B-9B on FIG. 9A, and shows the handle 10 and escutcheon 32 and related parts revealed. As can be seen, when the handle 10 is turned relative to the escutcheon 32, the extension catch 210 of the slidable trigger 200 will be in the semi-circular ring portion 234, and out of the notch portion 232 of the recess formed in the base 20 of the handle 10. As shown in FIG. 1F, in addition to the turn direction keyed washer 144 acting to prevent rotation of the handle 10 relative to the escutcheon more than about a quarter turn in either a clockwise or counterclockwise orientation, the fact that the semi-circular ring portion 234 extends through an arc of about 180 degrees likewise prevents over rotation of the handle 10 relative to the escutcheon 32 as the extension catch 210 of the slidable trigger 200 will be stopped by contact with the terminal ends 242A and 242B of the semi-circular ring portion 234. When the handle 10 is turned from its locked position, such as shown in FIG. 1A, the extension catch 210 of the slidable trigger 200 will no longer be in the cavity of the notch portion 232 of the recess, but will be in the narrower semi-circular ring portion 234.

Figure 10A:
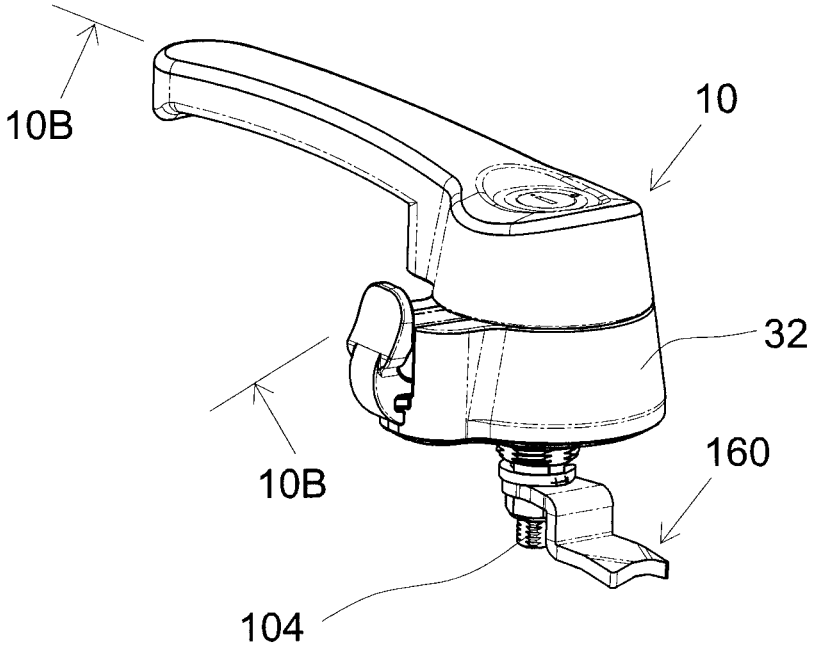
FIG. 10A is a front left isometric view showing the defeater latch handle of FIG. 1A unlocked and turn ¼ turn in a clockwise direction, as is permitted when the turn direction keyed washer is in the second orientation of FIG. 8.

FIG. 10A is a front left isometric view showing the defeater latch handle 100 unlocked and with its handle 10 turned ¼ turn in a clockwise direction relative to the escutcheon 32, as is permitted when the turn direction keyed washer is in the first orientation of FIG. 8. This also rotates the shaft 104 and its attached lock cam 160.

Figure 10B:
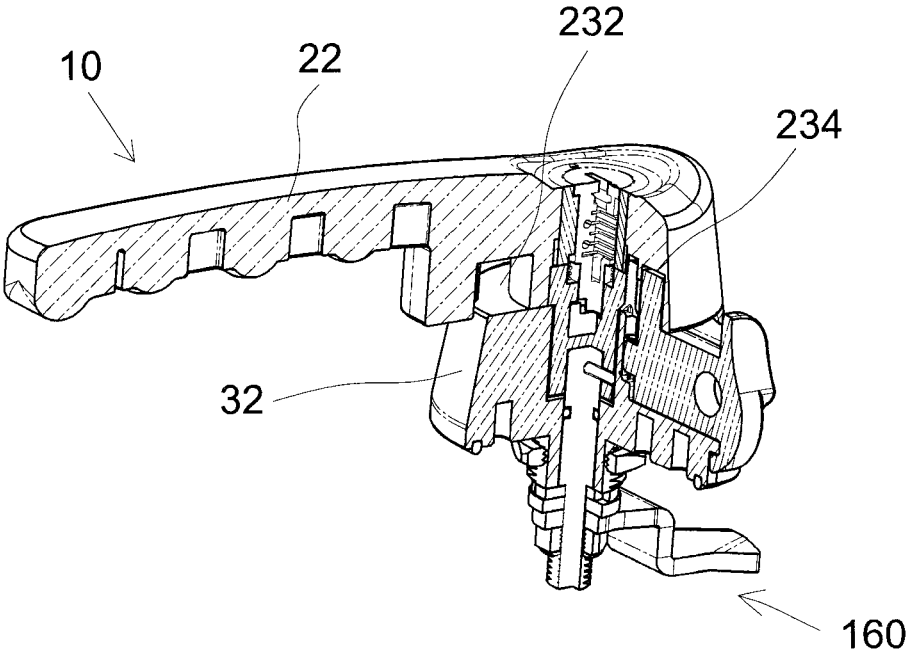
FIG. 10B is a side cross-sectional view through view lines 10B-10B of FIG. 10A.

FIG. 10B is a side cross-sectional view through view lines 10B-10B on FIG. 10A, and shows the handle 10 and escutcheon and related parts revealed. As can be seen, when the handle 10 is turned relative to the escutcheon, the extension catch 210 of the slidable trigger 200 will be in the semi-circular ring portion 234 of the recess formed in the base 20 of the handle 10. As shown in FIG. 1F, in addition to the turn direction keyed washer 144 acting to prevent rotation of the handle 10 relative to the escutcheon more than about a quarter turn in either a clockwise or counterclockwise orientation, the fact that the semi-circular ring portion 234 extends through an arc of about 180 degrees likewise prevents over rotation of the handle 10 relative to the escutcheon 32 as the extension catch 210 of the slidable trigger 200 will be stopped by contact with the terminal ends 242A and 242B of the semi-circular ring portion 234.

As described above, the embodiments of the defeater latch handle 100/300 accomplished the goals of providing an enhanced level of security while being easier to operate, more robust and simple in design to lower manufacturing costs, and less prone to malfunction or failure through years of use and weathering. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described.

What is claimed is:

1. A defeater latch handle, comprising:

a handle with a base portion with a top and a bottom, a recess formed in the bottom of the base portion, the recess including a recess notch portion, and a cylinder hole formed through the base portion;

a lock that is received in and accessible through the top of the base portion through the cylinder hole, the lock being rotatable relative to the base portion between a locked state and an unlocked state, the lock having an engagement;

a handle insert with a movable blocking device, the movable blocking device being engaged with the engagement of the lock to move the movable blocking device between a locked state and an unlocked state, the handle insert being attached to the base portion;

a shaft extending from the handle insert;

an escutcheon having a bore formed therein to rotatably receive the shaft, the bore having a bore notch formed therein which bore notch is adapted to receive the blocking device when the blocking device is in its locked stated, the escutcheon having a trigger slot formed therein; and a slidable trigger with an extension catch, the slidable trigger being adapted to slide in the trigger slot between a locked state, wherein the extension catch is positioned in the recess notch, and an unlocked state, wherein the extension catch is moved out of the recess notch portion in the base portion of the handle;

wherein the handle can only be rotated relative to the escutcheon when both the lock and the slidable trigger are in their unlocked states.

2. The defeater latch handle of claim 1, wherein the handle further comprising a grip portion extending from the base portion.

3. The defeater latch handle of claim 1, further comprising a biasing device to rotate the lock to its locked state.

4. The defeater latch handle of claim 1, further comprising a lock cam that is attached to the shaft.

5. The defeater latch handle of claim 1, further comprising a biasing device to bias the slidable trigger to its locked state.

6. The defeater latch handle of claim 1, wherein the shaft has a terminal threaded end that is non-round in profile, and wherein the escutcheon further comprising an extension extending from a bottom thereof, the extension having a stop formed thereon with a first side and a second side, and further comprising a turn direction key with an ear on an outer edge thereof and having an opening formed therein that permits the turn direction key to be placed on the non-round in profile of the terminal threaded end of the shaft in two orientations, wherein when the turn direction key is placed in a first orientation the ear will impact on the first side of the stop and prevent the handle from being rotated further in a clockwise direction and when the turn direction key is placed in a second orientation the ear will impact on the second side of the stop and prevent the handle from being rotated further in a counterclockwise direction.

7. The defeater latch handle of claim 1, further comprising a plug insert with a hole that receives the lock, and wherein the plug insert is received in the cylinder hole.

8. The defeater latch handle of claim 1, wherein the lock is selected from a key lock and a turnable cylinder with a turning end that is accessible from the top of the base portion of the handle through the cylinder hole.

9. The defeater latch handle of claim 1, wherein the handle insert is adapted to removably connect to a handle insert recess formed in the base portion, and wherein the shaft detachably connects to the handle insert.

10. The defeater latch handle of claim 1, wherein the engagement on the lock comprises a cam on a lower end of the lock, which cam engages with a complementary engagement formed on the movable blocking device, wherein when the lock is rotated to the unlocked state, the movable blocking device will slide laterally relative to the handle insert out of the bore notch of the escutcheon, and when the lock is rotated to a locked state, the movable blocking device will slide laterally relative to the handle insert and into the bore notch of the escutcheon.

11. The defeater latch handle of claim 1, wherein the trigger slot is a T-shaped slot and the slidable trigger has a lock hasp hole formed therein.

12. The defeater latch handle of claim 1, wherein the recess comprises a generally semi-circular ring portion and the recess notch portion communicates with and extends out of the semi-circular ring portion.

13. A defeater latch handle, comprising:

a handle with a base portion with a top and a bottom, a recess formed in the bottom of the base portion, the recess including a generally semi-circular ring portion and a recess notch portion that communicates with and extends out of the semi-circular ring portion, and a cylinder hole formed through the base portion;

a lock that is received in and accessible through the top of base portion through the cylinder hole, the lock being rotatable relative to the base portion between a locked state and an unlocked state, the lock having an engagement;

a biasing device to rotate the lock to its locked state;

a handle insert with a movable blocking device, the movable blocking device being engaged with the engagement on the lower end of the lock to move the movable blocking device between a locked state and an unlocked state, the handle insert being attached to the base portion;

a shaft extending from the handle insert;

an escutcheon having a bore formed therein to rotatably receive the shaft, the bore having a bore notch formed therein which notch is adapted to receive the blocking device when the blocking device is in its locked stated, the escutcheon having a trigger slot formed therein;

a slidable trigger with an extension catch, the slidable trigger being adapted to slide in the trigger slot between a locked state, wherein the extension catch is positioned in the recess notch, and an unlocked state, wherein the extension catch is moved out of the recess notch portion in the base portion of the handle and into the semi-circular ring portion;

a biasing device to bias the trigger latch to is locked state; and a lock cam that is attached to the shaft;

wherein the handle can only be rotated relative to the escutcheon when both the lock and the slidable trigger are in their unlocked states.

14. The defeater latch handle of claim 13, wherein the shaft has a terminal threaded end that is non-round in profile, and wherein the escutcheon further comprising an extension extending from a bottom thereof, the extension having a stop formed thereon with a first side and a second side, and further comprising a turn direction key with an ear on an outer edge thereof and having an opening formed therein that permits the turn direction key to be placed on the non-round in profile of the terminal threaded end of the shaft in two orientations, wherein when the turn direction key is placed in a first orientation the ear will impact on the first side of the stop and prevent the handle from being rotated further in a clockwise direction and when the turn direction key is placed in a second orientation the ear will impact on the second side of the stop and prevent the handle from being rotated further in a counterclockwise direction.

15. The defeater latch handle of claim 13, further comprising a plug insert with a hole that receives the lock, and wherein the plug insert is received in the cylinder hole.

16. The defeater latch handle of claim 13, wherein the engagement on the lock comprises a cam on a lower end of the lock, which cam engages with a complementary engagement formed on the movable blocking device, wherein when the lock is rotated to the unlocked state, the movable blocking device will slide laterally relative to the handle insert out of the bore notch of the escutcheon, and when the lock is rotated to a locked state, the movable blocking device will slide laterally relative to the handle insert and into the bore notch of the escutcheon.

17. The defeater latch handle of claim 13, wherein the slidable trigger has a lock hasp hole formed therein.

18. A defeater latch handle, comprising:

a handle with a base portion with a top and a bottom, a recess formed in the bottom of the base portion, the recess including a recess notch portion, and a cylinder hole formed through the base portion;

a lock that is received in and accessible through the top of the base portion through the cylinder hole, the lock being rotatable relative to the base portion between a locked state and an unlocked state, the lock having an engagement;

a movable blocking device, the movable blocking device being engaged with the engagement of the lock to move the movable blocking device between a locked state and an unlocked state;

a shaft extending below the bottom of the base portion of the handle;

an escutcheon having a bore formed therein through which rotatably passes the shaft, the bore having a bore notch formed therein which bore notch is adapted to receive the blocking device when the blocking device is in its locked stated, the escutcheon having a trigger slot formed therein; and a slidable trigger with an extension catch, the slidable trigger being adapted to slide in the trigger slot between a locked state, wherein the extension catch is positioned in the recess notch, and an unlocked state, wherein the extension catch is moved out of the recess notch portion in the base portion of the handle;

wherein the handle can only be rotated relative to the escutcheon when both the lock and the slidable trigger are in their unlocked states.

19. The defeater latch handle of claim 18, where the movable blocking device is associated with a handle insert which handle insert is connected to a handle insert recess formed in the base portion, and wherein the shaft detachably connects to the handle insert.

20. The defeater latch handle of claim 18, wherein the engagement on the lock comprises a cam on a lower end of the lock, which cam engages with a complementary engagement formed on the movable blocking device, wherein when the lock is rotated to the unlocked state, the movable blocking device will slide laterally relative to the handle insert out of the bore notch of the escutcheon, and when the lock is rotated to a locked state, the movable blocking device will slide laterally relative to the handle insert and into the bore notch of the escutcheon.

* * * * *